US010564576B2

(12) United States Patent
Tanaka et al.

(10) Patent No.: US 10,564,576 B2
(45) Date of Patent: Feb. 18, 2020

(54) IMAGE FORMING APPARATUS THAT PERFORMS A PROCESS OF ROTATING A NEW ENDLESS BELT BEFORE AN IMAGE FORMING OPERATION

(71) Applicant: CANON KABUSHIKI KAISHA, Tokyo (JP)

(72) Inventors: Kenichi Tanaka, Ushiku (JP); Taiya Hirayama, Moriya (JP); Takeshi Kozuma, Tokyo (JP); Atsushi Ishigami, Kashiwa (JP); Koji Takematsu, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/184,268

(22) Filed: Nov. 8, 2018

(65) Prior Publication Data

US 2019/0146386 A1 May 16, 2019

(30) Foreign Application Priority Data

Nov. 13, 2017 (JP) ..... 2017-218023

(51) Int. Cl.
*G03G 15/20* (2006.01)

(52) U.S. Cl.
CPC ..... *G03G 15/2028* (2013.01); *G03G 15/205* (2013.01); *G03G 15/2053* (2013.01); *G03G 2215/2016* (2013.01); *G03G 2215/2025* (2013.01)

(58) Field of Classification Search
CPC ..... G03G 15/2017; G03G 15/2053; G03G 2215/2016; G03G 2215/2019
See application file for complete search history.

(56) References Cited

U.S. PATENT DOCUMENTS

2007/0264059 A1* 11/2007 Maeda ..... G03G 15/2025 399/320
2008/0008482 A1* 1/2008 Kurita ..... G03G 15/2064 399/33
2014/0226998 A1* 8/2014 Hasegawa ..... G03G 15/2017 399/67
2015/0346664 A1* 12/2015 Tanaka ..... G03G 15/502 399/81
2017/0060051 A1* 3/2017 Tamaki ..... G03G 15/553

FOREIGN PATENT DOCUMENTS

JP 2004-198659 A 7/2004

* cited by examiner

*Primary Examiner* — Carla J Therrien
(74) *Attorney, Agent, or Firm* — Venable LLP

(57) ABSTRACT

An image forming apparatus includes an image forming portion that forms a toner image on a recording material, and a first rotatable member and a second rotatable member, which form a nip therebetween in which the toner image, formed on the recording material by the image forming portion, is heated. A belt unit includes an endless belt that externally heats the first rotatable member, and a supporting mechanism rotatably supporting the endless belt. A moving mechanism moves the belt unit so as to be movable between a contact position and a spaced position. In addition, a controller executes a process in which one of the belt unit with a new endless belt and a new belt unit with a new endless belt is moved to the contact position, and then, the new endless belt is rotated for a predetermined time by the first rotatable member.

8 Claims, 12 Drawing Sheets

(a)

(b)

(a) BEFORE HEATING (b) AFTER HEATING

IMAGE FORMING APPARATUS THAT PERFORMS A PROCESS OF ROTATING A NEW ENDLESS BELT BEFORE AN IMAGE FORMING OPERATION

This application claims the benefit of Japanese Patent Application No. 2017-218023 filed on Nov. 13, 2017, which is hereby incorporated by reference herein in its entirety.

FIELD OF THE INVENTION AND RELATED ART

The present invention relates to an image forming apparatus. As the image forming apparatus, for example, it is possible to use a copying machine, a printer, a facsimile machine, and a multi-function machine having a plurality of functions of these machines.

In the image forming apparatus of an electrophotographic type, conventionally, a toner image is formed on a recording material and then is fixed on the recording material by a fixing device under application of heat and pressure. As an example of such a fixing device, in a fixing device disclosed in Japanese Laid-Open Patent Application 2004-198659, an external heating belt has been used.

When such an external heating belt is continuously used, exchange of the externally heating belt is needed in some cases.

An inner peripheral surface of an unused external heating belt is roughened, however, and, therefore, there is a liability that an inconvenience is caused to occur in an initial stage of use.

SUMMARY OF THE INVENTION

According to one aspect, the invention provides an image forming apparatus comprising an image forming portion configured to form a toner image on a recording material, a first rotatable member and a second rotatable member, which are configured to form a nip therebetween in which the toner image, formed on the recording material by the image forming portion, is heated, a belt unit including an endless belt configured to externally heat the first rotatable member and a supporting mechanism rotatably supporting the endless belt, a moving mechanism configured to move the belt unit so as to be movable between a contact position, in which the endless belt contacts the first rotatable member, and a spaced position, in which the endless belt is spaced from the first rotatable member, and a controller configured to execute exchange of the endless belt or the belt unit on the basis of information prompting exchange thereof, and to execute a process in which the belt unit with a new endless belt or a new belt unit with a new endless belt is moved to the contact position, and then the new endless belt is rotated for a predetermined time by the first rotatable member.

Further features of the present invention will become apparent from the following description of exemplary embodiments with reference to the attached drawings.

Figure 6:
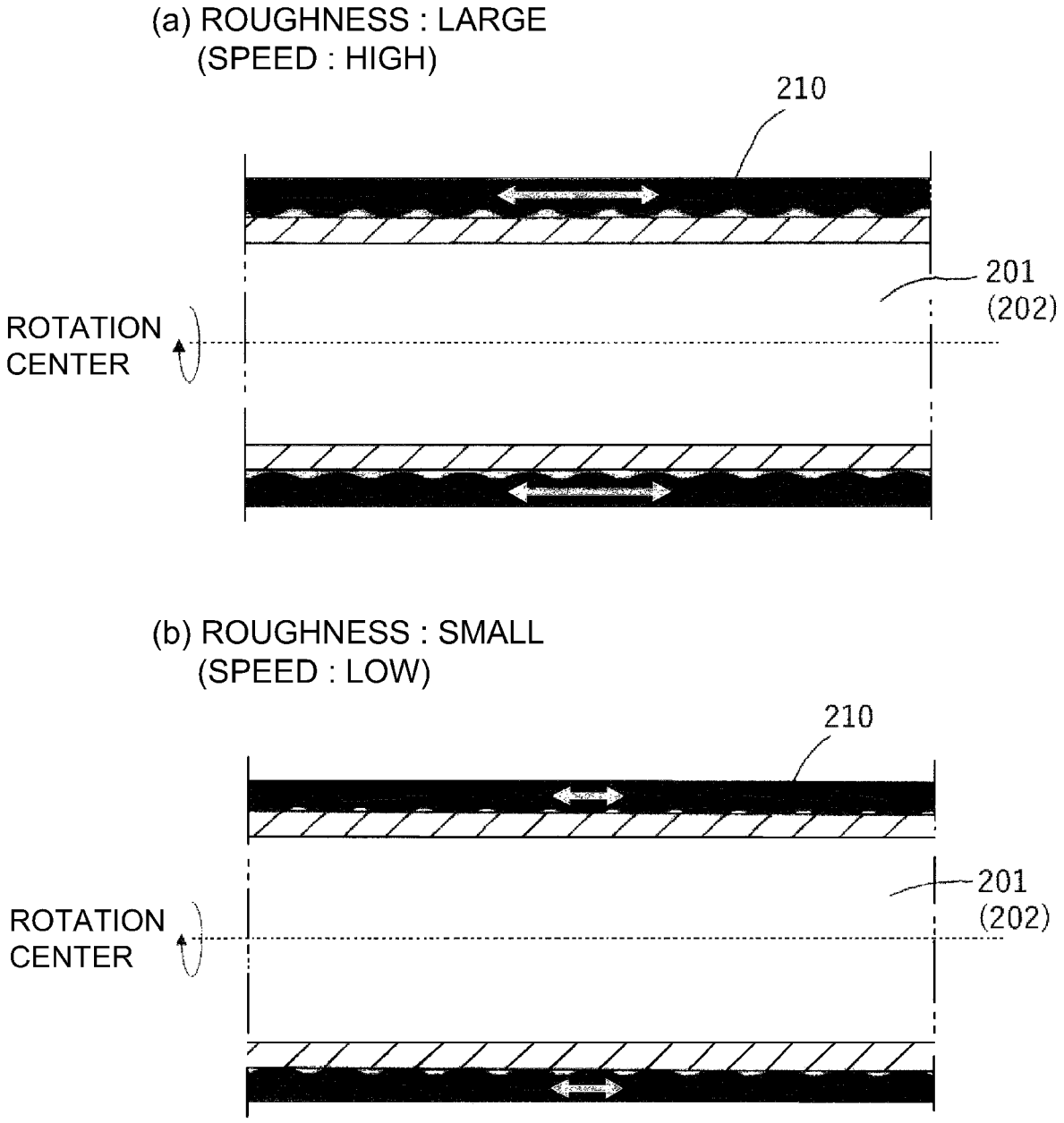

Parts (a) and (b) of FIG. 6 are illustrations of a relationship between a roughness of an inner peripheral surface of a belt and a belt shifting speed.

Figure 7:
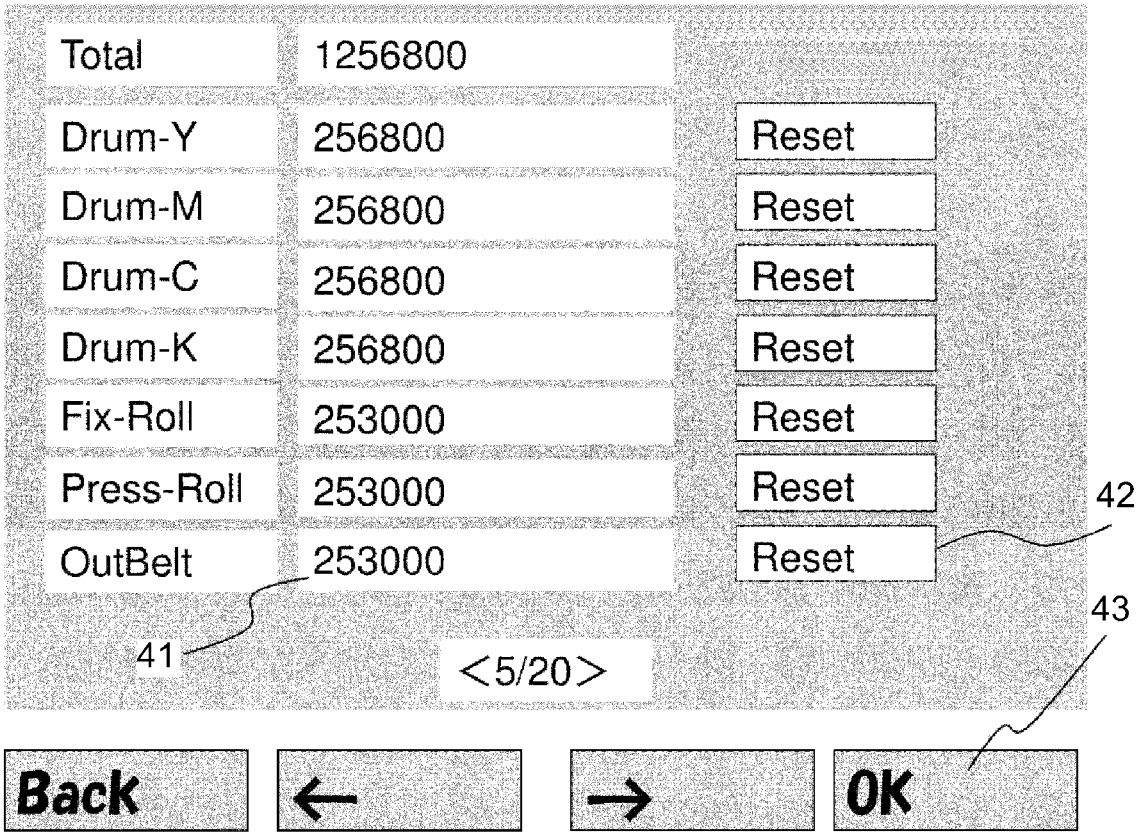

FIG. 7 is a schematic view of a screen displaying an integrated number of passed sheets as to each of various constituent elements of the image forming apparatus.

Figure 8:
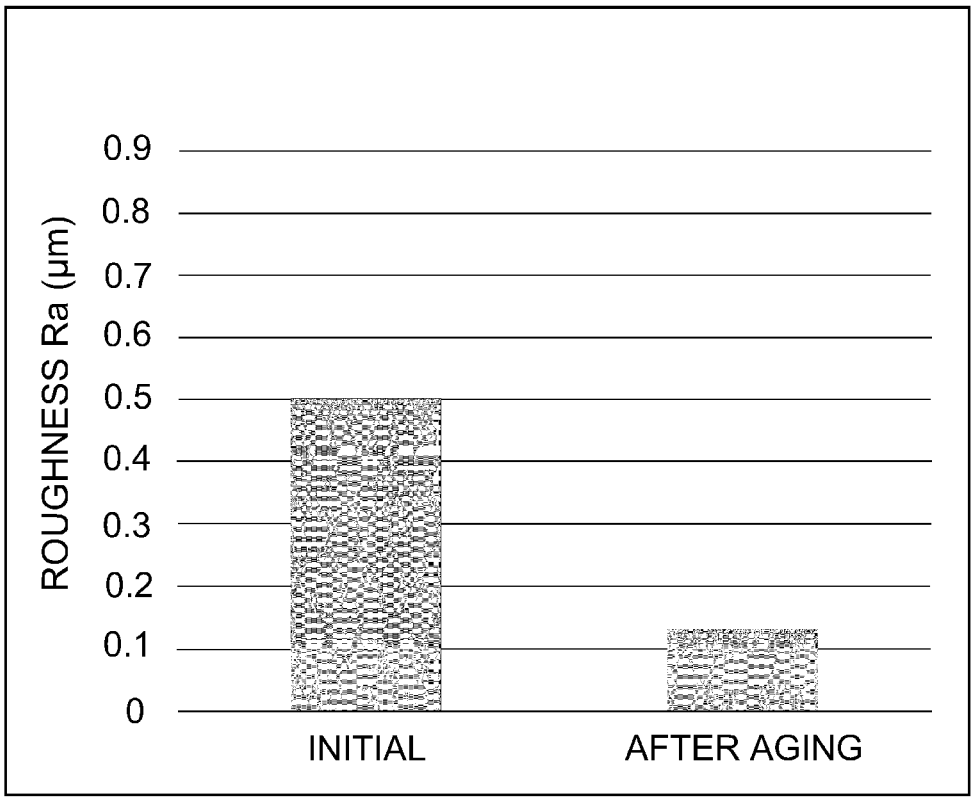
Figure 8:
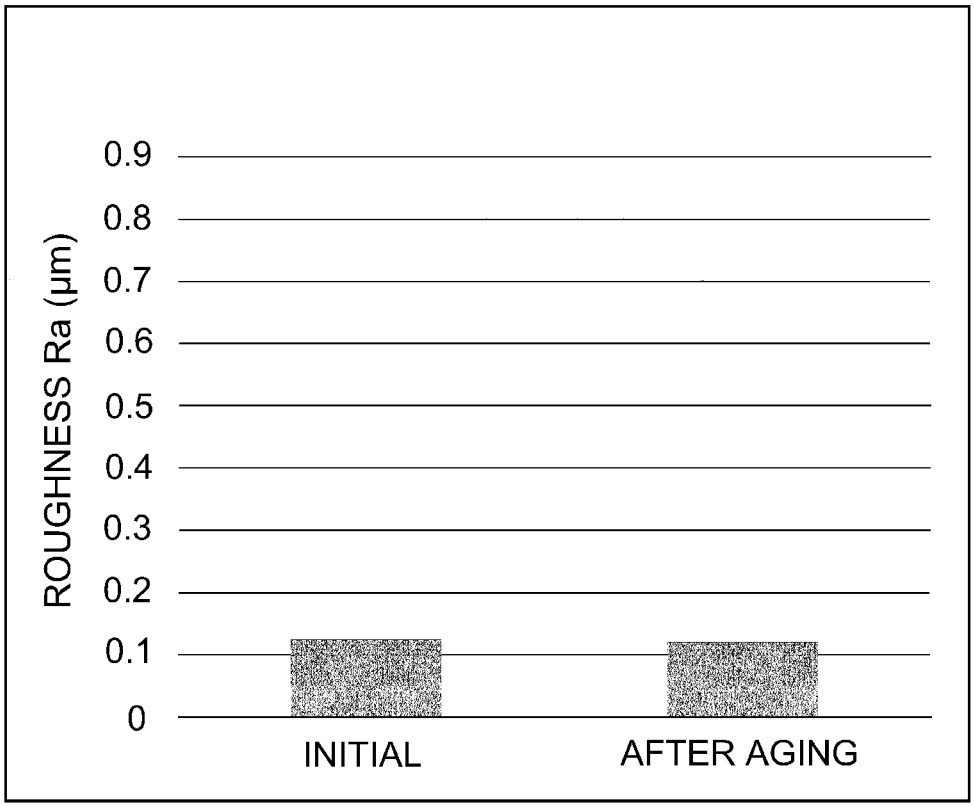

Parts (a) and (b) of FIG. 8 are examples of a graph showing a change of a surface roughness (Ra) of an inner peripheral surface of the externally heating belt before and after the aging operation.

Figure 9:
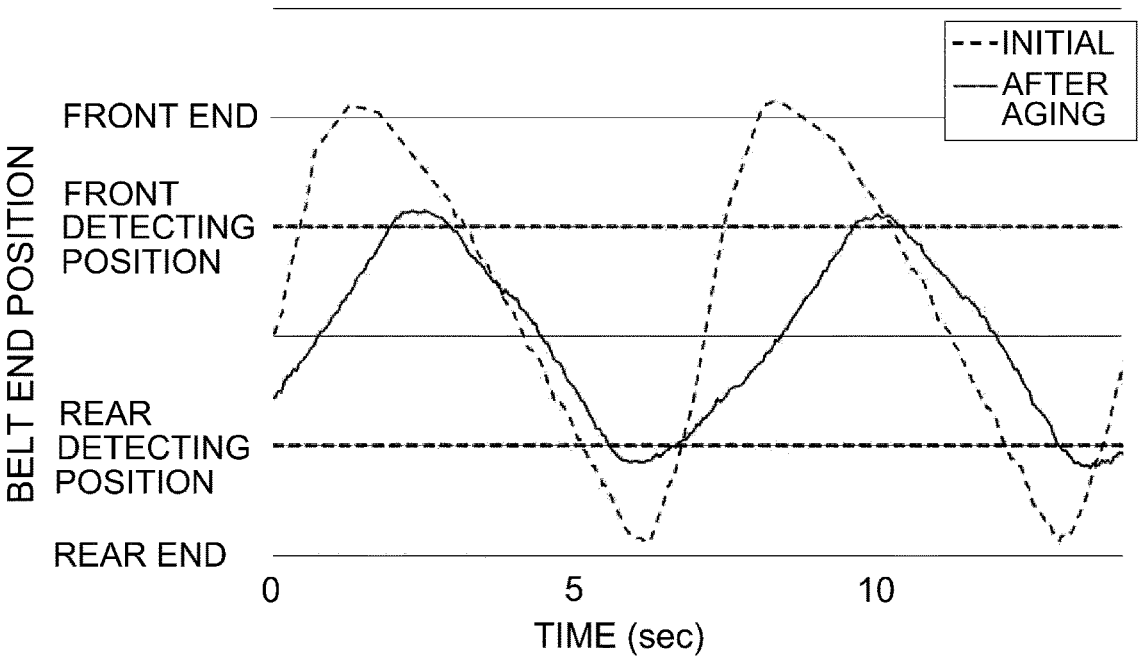

FIG. 9 is a schematic view showing a reciprocating operation of the externally heating belt before and after the aging operation.

Figure 10:
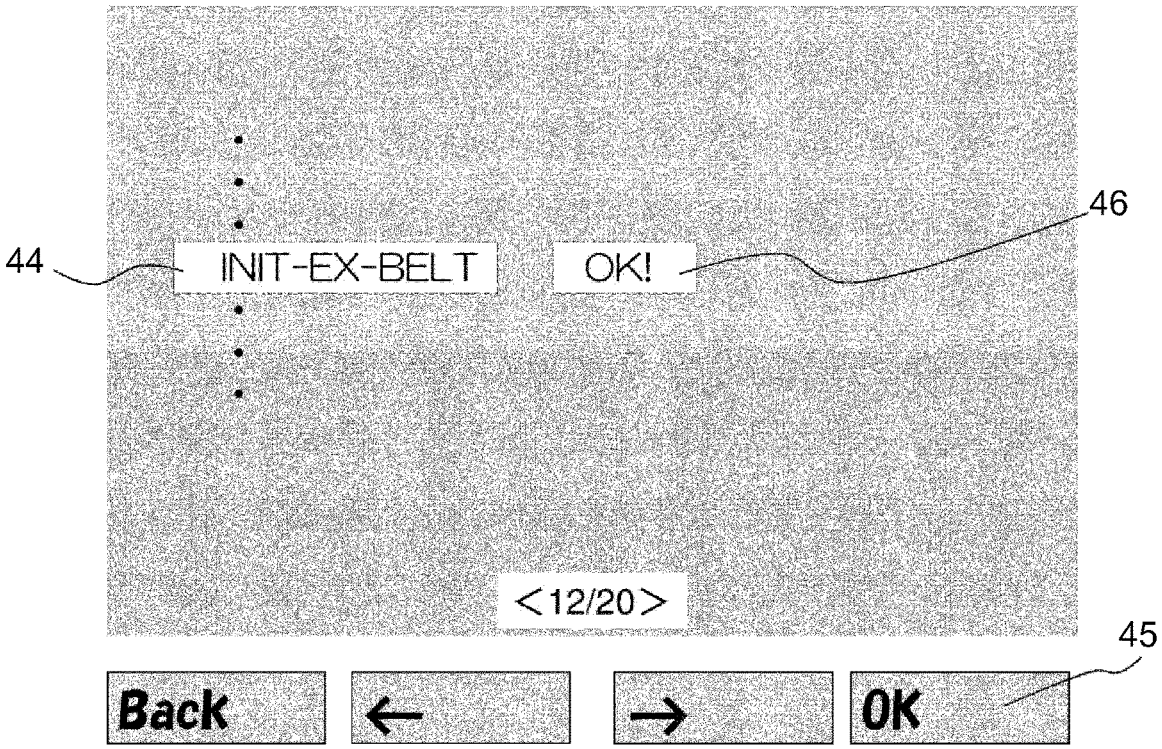

FIG. 10 is a schematic view of a screen on which an aging mode execution button is displayed at a display portion of an operating portion (Embodiment 2).

Figure 11:
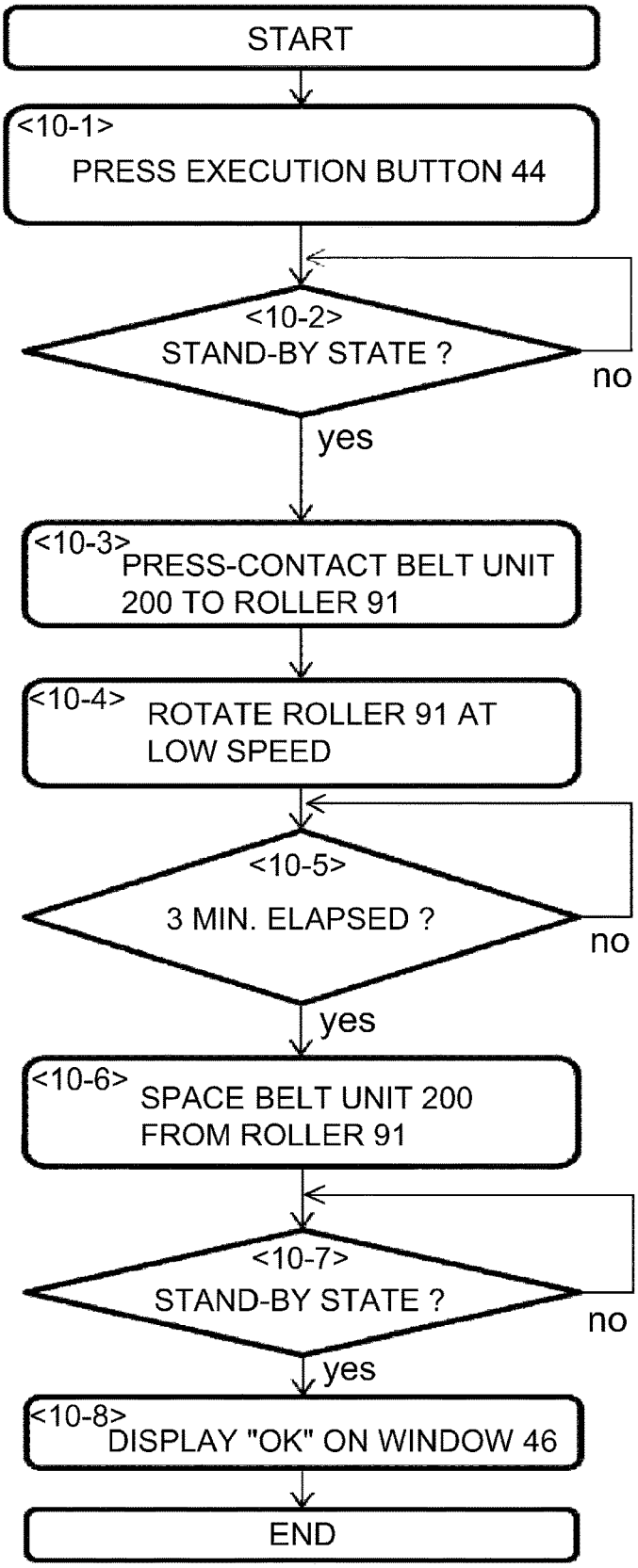

FIG. 11 is a flowchart showing an operation in a case in which an aging operation by the aging mode execution button is performed.

Figure 12:
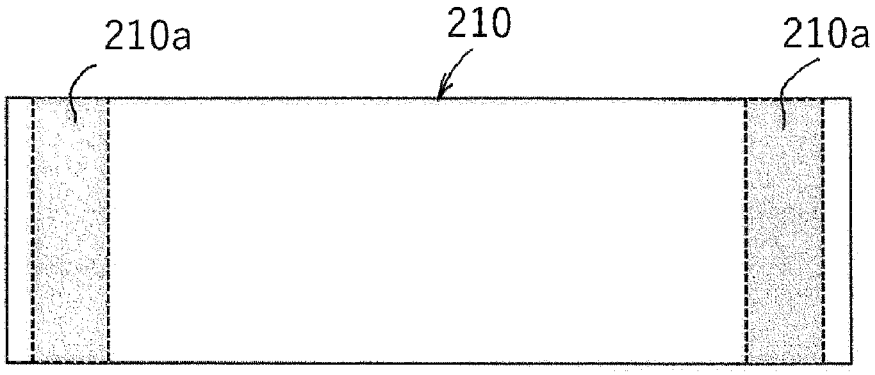
Figure 12:
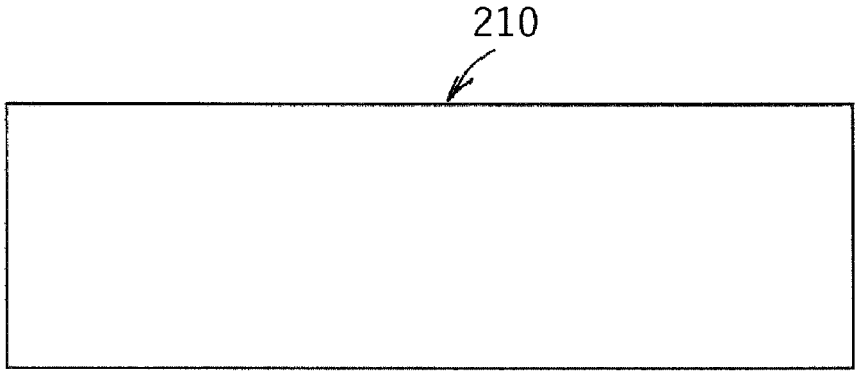

Parts (a) and (b) of FIG. 12 are schematic views showing an external heating belt in Embodiment 3.

Figure 13:
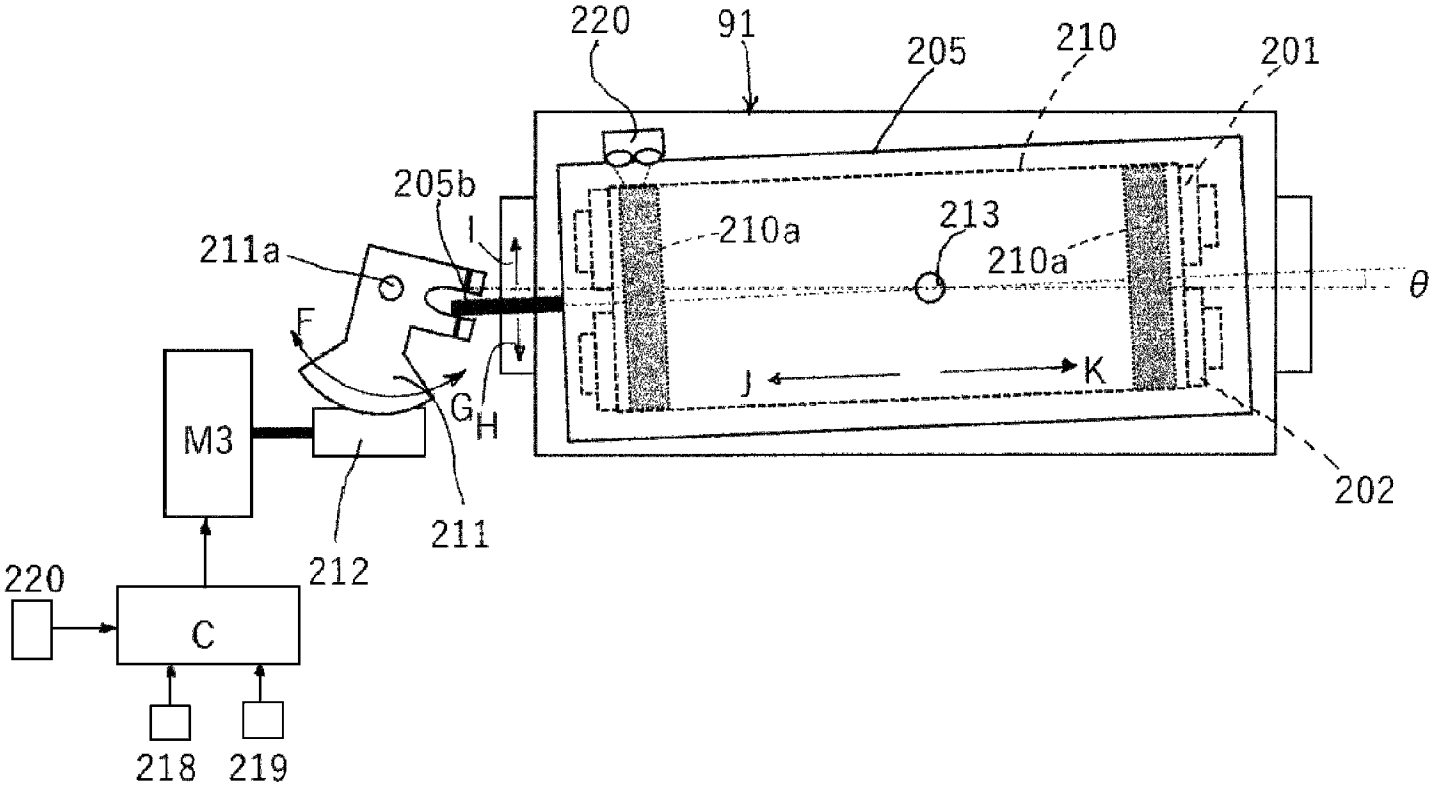

FIG. 13 is a schematic view showing the external heating belt unit in Embodiment 3.

DESCRIPTION OF EMBODIMENTS

Embodiments of the present invention will be specifically described with reference to the drawings.

Embodiment 1

Structure of Image Forming Apparatus

Figure 2:
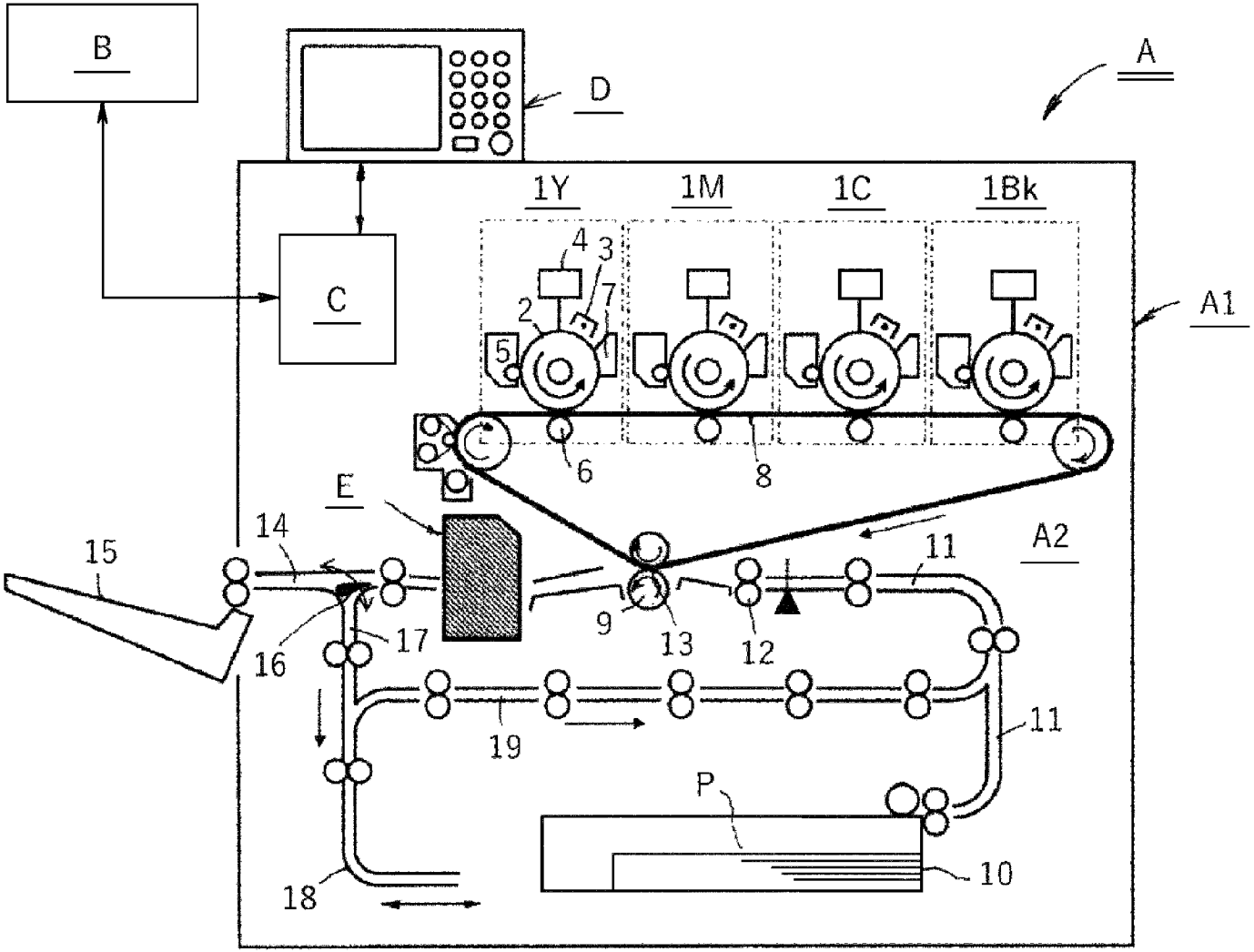
FIG. 2 is a schematic sectional view of an example of an image forming apparatus.

FIG. 2 is a schematic view showing a general structure of an image forming apparatus A in this embodiment, and the image forming apparatus A is a full-color electrophotographic printer of an intermediary transfer type and a tandem type. This image forming apparatus A is capable of forming a full-color toner image or a monochromatic (single color) toner image on a sheet-like recording material P through an image forming operation (printing operation) by an image forming portion A2 inside an apparatus main assembly A1 on the basis of image information inputted from an external device B, such as a print server to a controller C.

On the apparatus main assembly A1, an operating portion (receiving portion) D, constituted by a touch panel (display portion) and physical buttons, is provided, so that various pieces of electrical information are transferred between the operating portion D and the controller C. A user (operator) and a maintenance operator are capable of carrying out a change of various settings, an image forming operation, an operation in a roller apparatus (device) control mode, and the like, of the image forming apparatus A by using the operating portion D. The controller C effects integrated control of the image forming apparatus A.

The image forming portion A2 for forming toner images on recording materials (sheets) P includes four image forming units 1Y, 1M, 1C, and 1Bk for forming toner images of colors of yellow (Y), magenta (M), cyan (C), and black (Bk), respectively. Each of the image forming units 1Y, 1M, 1C, and 1Bk includes predetermined electrophotographic process devices, such as a photosensitive drum 2, a charger 3, a laser scanner (image exposure device) 4, a developing device 5, a primary transfer roller 6, and a drum cleaner 7.

In order to avoid complication of the figure, reference numerals of these devices of the image forming units 1M, 1C, and 1Bk, other than the image forming units 1Y, were omitted.

The image forming portion A2 further includes an intermediary transfer belt (hereafter referred to as an ITB) 8 for carrying and conveying the toner images transferred from the respective drums 2 by the primary transfer rollers 6, and includes a secondary transfer roller 9 for transferring the toner images from the ITB 8 onto the sheet P. An electrophotographic process and an image forming operation of the image forming portion A2 having the above-described structure are well known, and, therefore will be omitted from detailed description.

The sheets P are fed one by one from a cassette 10 at predetermined control timing. Then, the sheet P passes through a feeding path 11 and is introduced at predetermined control timing by a registration roller pair (RG roller pair) 12 into a secondary transfer nip (hereafter referred to as an N2 nip) 13 formed by the ITB 8 and the secondary transfer roller 9. The sheet P is subjected to secondary transfer of the toner images from the ITB 8 side in a process of being nipped and fed through the N2 nip 13. Then, the sheet P coming out of the N2 nip 13 is separated from the ITB 8 and is introduced into a fixing device (fixing portion) E, in which the toner image on the sheet P is fixed as a fixed image under application of heat and pressure. The fixing device E will be described later.

The sheet P coming out of the fixing device E passes through a feeding path 14 and is sent (discharged) onto a discharge tray 15 in a case in which an image forming job (print job) is a one-side image forming job, in which the image is formed on only one surface (side) of the sheet P.

In a case in which the image forming job is a double-side image forming job, in which the images are formed on double surfaces (sides) consisting of one surface (side) and the other surface (side) of the sheet P, the sheet P, which comes out of the fixing device E and on which the image has already been formed at one surface (side) thereof, is changed in course toward a feeding path 17 by control of a flapper 16 and thus, is introduced into a feeding path 18 for double-side image formation. Then, the sheet P is fed in a switch-back manner, is introduced into a pre-feeding path 19, and then, is introduced again into the feeding path 11 in a state in which the sheet P is turned upside down. Thereafter, similarly as in the case of one-side image formation, the sheet P is fed through a route including the RG roller pair 12, the N2 nip 13, the fixing device E, and the feeding path 14, and then, is sent as a double-side image-formed product onto the discharge tray 15.

Structure of Fixing Device

Figure 3:
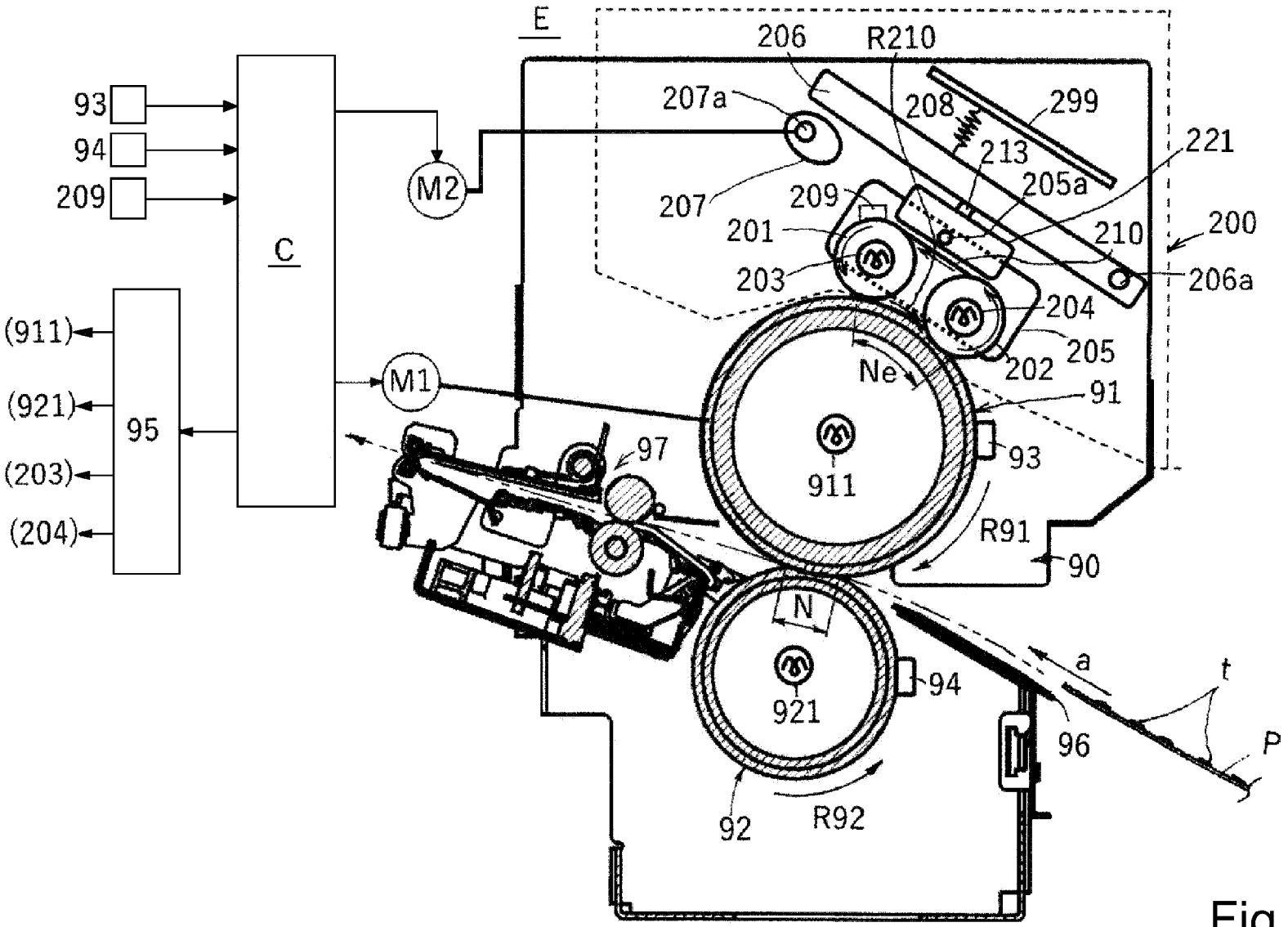
FIG. 3 is a schematic sectional view of a fixing device mounted in the image forming apparatus of FIG. 2.

FIG. 3 is a schematic sectional view of the fixing device E in this embodiment. This fixing device E includes a fixing roller 91 as a rotatable member (fixing member) for heating the toner image on the sheet (recording material) P, and includes an external heating belt unit (belt feeding device) 200 for heating an outer surface of the fixing roller 91 in contact with the outer surface of the fixing roller 91. The fixing device E further includes a pressing roller 92 as a rotatable member (pressing member) for forming a fixing nip N, in which the sheet P, carrying thereon toner images t, is nipped and fed and thus, is heated, in cooperation with the fixing roller 91.

(1) Fixing Roller

The fixing roller 91 is rotatably shaft-supported between side plates of a device frame 90 of the fixing device E on one end side (front side) and the other end side (rear side) with respect to a longitudinal direction (direction perpendicular to a surface of the drawing sheet of FIG. 3). The fixing roller 91 is rotationally driven at a peripheral speed, which is a predetermined speed (first speed) of, for example, 500 mm/sec, in the clockwise direction of an arrow R91 during an image forming operation (printing operation) of the image forming apparatus A by a motor (driving source) M1 controlled by the controller.

The fixing roller 91 includes a cylindrical metal core made of aluminum in this embodiment and having an outer diameter of 80 nm, a thickness of 3 mm, and a length of 350 mm. On the metal core, as a heat-resistant elastic layer, a silicone rubber is coated in a thickness of 1.5 mm. On the elastic layer, in order to improve a parting property with toner, a layer of fluorine-containing resin material (perfluorualkoxy alkane (PFA) tube in this embodiment) is coated as a heat-resistant parting layer in a thickness of 50 μm.

Inside the metal core of the fixing roller 91, as a heat generating element, a halogen heater 911 with, for example, a normal rated power of 1200 W, is provided. The heater 911 generates heat by energization from an energizing portion 95 controlled by the controller C. The fixing roller 91 is internally heated by heat generation of this heater 911. Then, a surface temperature of the fixing roller 91 is detected by a thermistor 93 as a temperature detecting means contacting the fixing roller 91. Detection temperature information is input to the controller C. On the basis of the detection temperature information, the controller C controls electrical power supplied from the energization portion 95 to the heater 911 so that the surface temperature of the fixing roller 91 is a target temperature of, for example, 200° C.

(2) Pressing Roller

The pressing roller 92 is provided in a position that is substantially parallel to the fixing roller 91 on a side under the fixing roller 91, is rotatably shaft-supported between the side plates of the device frame 90 on one end side and the other end side, and is pressed against the fixing roller 91 at a predetermined pressure by a pressing means (not shown). By this pressure, the fixing nip N, with a predetermined width with respect to a sheet feeding direction a, is formed between the fixing roller 91 and the pressing roller 92 due to elastic flexure of the elastic layers on the fixing roller 91 side and the pressing roller 92 side. The pressing roller 92 is rotated by rotational drive of the fixing roller 91 in the counterclockwise direction of an arrow R92 at a peripheral speed that is substantially the same as the peripheral speed of the fixing roller 91.

The pressing roller 92 includes a cylindrical metal core made of aluminum in this embodiment, and having an outer diameter of 60 nm, a thickness of 4 mm, and a length of 350 mm. On the metal core, as a heat-resistant elastic layer, a silicone rubber is coated in a thickness of 2 mm. On the elastic layer, in order to improve a parting property with toner, a layer of fluorine-containing resin material (PFA tube in this embodiment) is coated as a heat-resistant parting layer in a thickness of 50 μm.

Inside the metal core of the pressing roller 92, as a heat generating element, a halogen heater 921 with, for example, a normal rated power of 300 W is provided. The heater 921 generates heat by energization from an energizing portion 95 controlled by the controller C. The pressing roller 92 is internally heated by heat generation of this heater 921. Then, a surface temperature of the pressing roller 92 is detected by a thermistor 94 as a temperature detecting means contacting the pressing roller 92, and detection temperature information is input to the controller C. On the basis of the detection temperature information, the controller C controls electrical power supplied from the energization portion 95 to the heater 921 so that the surface temperature of the pressing roller 92 is a target temperature of, for example, 130° C.

(3) External Heating Belt Unit

On the fixing roller 91, the external heating belt unit (belt feeding device, hereinafter referred to as a belt unit) 200, for heating the fixing roller 91 from the outer surface of the fixing roller 91, in order to maintain the surface temperature of the fixing roller 91 even during continuous sheet passing, is provided.

The belt unit 200 includes an endless external heating belt (endless belt, hereafter referred to as a belt) 210, which is an external heating member for heating the outer surface of the fixing roller 91 in contact with the outer surface of the fixing roller 91. The belt unit 200 further includes a supporting mechanism, including first and second supporting rollers 201 and 202, which are substantially parallel to each other, and which not only rotatably support an inner surface of the belt 210, but also are used as supporting members for pressing the belt 210 against the fixing roller 91. The belt 210 is stretched by these two supporting rollers 201 and 202.

The rollers 201 and 202 are rotatably supported by a frame 205. The rollers 201 and 202 are in a positional relationship such that, with respect to the rotational direction R91 of the fixing roller 91, the first supporting roller 201 is on an upstream side and the second supporting roller 202 is on a downstream side. The second supporting roller 202 also functions as a tension roller for imparting tension to the belt 210.

Each of the supporting rollers 201 and 202 includes a cylindrical metal core made of aluminum in this embodiment, and having an outer diameter of 30 mm, a thickness of 2 mm, and a length of 360 mm. The belt 210 is a heat-resistant flexible belt including a base material layer made of a resin material, such as polyimide, and having an outer diameter of 60 mm, a thickness of 100 μm, and a width of 350 mm. In order to prevent deposition of the toner on the base material layer, the base material layer is coated with a 20 μm-thick layer of a fluorine-containing resin material (PFA tube in this embodiment) as a heat-resistant slidable layer.

Inside the rollers 201 and 202, halogen heaters 203 and 204, respectively, with a normal rated power of, for example, 1000 W, are provided as heat generating elements. The heaters 203 and 204 are disposed so as to heat the rollers 201 and 202, respectively. The heaters 203 and 204 generate heat by energization from the energizing portion 95 controlled by the controller C. The rollers 201 and 202 are internally heated by heat generation of the heaters 203 and 204, respectively. For that reason, the belt 210 stretched by the rollers 201 and 202, and is heated by the heat of the rollers 201 and 202.

Then, the surface temperature of the belt 210 is detected by a thermistor 209 as a temperature detecting means contacting the belt 210, and detection temperature information is fed back to the controller C. On the basis of the detection temperature information input to the controller C, the controller C controls electrical power supplied from the energization portion 95 to the heaters 203 and 204 so that the surface temperature of the belt 210 is a predetermined target temperature.

The frame 205 is supported rotatably about a frame rotation shaft 205*a* by an intermediary frame 221. The intermediary frame 221 is supported rotatably about a vertical shaft 213 by a pressing arm 206, so that the intermediary frame 221 and the frame 205 are rotatably supported integrally by the pressing arm 206. The pressing arm 206 is supported so as to be capable of performing a rotation operation in an up-down direction about a shaft 206*a*, provided at one end portion thereof, between the side plates of the device frame 90, on one end side and the other end side of the device frame 90.

That is, the intermediary frame 221 exists between the pressing arm 206 and the frame 205. The pressing arm 206 and the intermediary frame 221 are connected by the vertical shaft (pivot shaft) 213. The intermediary frame 221 and the frame 205 are integrally rotated about the vertical shaft 213 relative to the pressing arm 206, and the intermediary frame 221 and the frame 205 are connected by the frame rotation shaft (lateral shaft) 205*a*. The frame 205 is rotated about the lateral shaft 205*a* relative to the intermediary frame 221.

Between the pressing arm 206 and a spring receiving plate 299 fixedly provided above the pressing arm 206, a pressing spring 208 is compressedly provided. The pressing arm 206 is always rotationally urged about the shaft 206*a* in a direction toward the fixing roller 91 by a compressive reaction force of the pressing spring 208. For that reason, in a free state of the pressing arm 206, the belt 210 press-contacts the upper surface of the fixing roller 91 with a predetermined pressing force.

That is, by weights of the frame 205 including the members 210, 201 and 203 and the pressing arm 206 and by the pressing force of the pressing spring 208, a lower-side portion of the belt 210 between the rollers is press-contacted to the upper surface of the fixing roller 91 and the rollers 201 and 202 are urged toward the upper surface of the fixing roller 91 through the belt 210. As a result, as shown in FIG. 3, the belt 210 is press-contacted hermetically to the upper surface of the fixing roller in a tangentially contacted manner with a large width, while following curvature of the fixing roller 91. As a result, between the belt 210 and the fixing roller 91, a heating nip (contact surface) Ne, having a large width with respect to the rotational direction of the fixing roller 91, is formed.

In this embodiment, the frame 205 including the rollers 201 and 202, the intermediary frame 221, the pressing arm 206, the pressing spring 208, the spring receiving plate 299, and the like, constitute a pressing mechanism for causing the belt 210 to press-contact the fixing roller 91 as an opposing member.

Below the pressing arm 206, at the other end portion of the pressing arm 206 on a side opposite from the shaft 206*a* side, a cam shaft 207*a* is rotatably shaft-supported between the side plates of the device frame 90 on one end side and the other end side. On this cam shaft 207*a*, an eccentric cam 207 is fixedly provided. The cam shaft 207*a* is selectively switch-controlled by a motor M2 controlled by the controller C, so that a rotation angle of the eccentric cam 207 is selectively switched between a first rotational angle state, in which a large protrusion portion of the eccentric cam 207 is oriented obliquely downward, as shown in FIG. 3, and a second rotational angle state, in which the large protrusion portion is oriented upwardly.

Further, the state of the eccentric cam 207 is switched to the first rotational angle state in which the large protrusion portion is oriented obliquely downward, and is then maintained in the first rotational angle state, so that the eccentric cam 207 is maintained in a non-contact (non-interference) attitude with the pressing arm 206. For that reason, the pressing arm 206 is in a free state, so that the pressing mechanism takes a press-contact position of FIG. 3 in which the heating nip Ne is formed by the belt 210 and the fixing roller 91 pressing state of the pressing mechanism).

On the other hand, the state of the eccentric cam 207 is switched from the first rotational angle state to the second rotational angle state in which the large protrusion portion is oriented upwardly. Then, the pressing arm 206 is raised and rotated about the shaft 206*a* by the eccentric cam 207 against the compressive reaction force of the pressing spring 208, and then is maintained at a predetermined raised position. In this state, the intermediary frame 221 and the frame 205 are raised together with the pressing arm 206 in a predetermined manner, so that the rollers 201 and 202 and the belt 210 are spaced from the fixing roller 91. That is, the pressing mechanism takes a spaced position in which the belt 210 is spaced from the fixing roller 91 (a pressure (pressing force)-released state of the pressing mechanism).

Thus, the pressing arm 206 is rotated downwardly or upwardly about the shaft 206*a* by rotating the eccentric cam (pressing cam) 207 between the first rotational angle state and the second rotational angle state, so that the frame 205 is constituted so that the belt 210 is contactable to and retractable from the fixing roller 91. In the above arrangement, the shaft 207*a*, the eccentric cam 207, the motor M2, and the like, constitute a moving mechanism for moving the pressing mechanism so that the pressing mechanism can take a contact position in which the heating nip Ne is formed by the belt 210 and the fixing roller 91, and a spaced position in which the belt 210 is spaced from the fixing roller 91.

By the pressing mechanism and the moving mechanism, which are described above, a contact-and-separation (spacing) mechanism capable of moving the belt unit 200 (belt 210) so as to take the press-contact position and the spaced position relative to the fixing roller 91. The contact-and-separation mechanism can also have a constitution capable of moving the fixing roller 91 so as to take the press-contact position and the spaced position relative to the belt unit 200 (belt 210). That is, the contact-and-separation mechanism is a mechanism capable of moving at least one of the belt unit 200 (belt 210) and the fixing roller 91 so as to take the press-contact position in which the belt unit 200 (belt 210) and the fixing roller 91 are in press-contact with each other with a predetermined force, and the spaced position in which the belt unit 200 (belt 210) and the fixing roller 91 are spaced from each other. The controller C controls an operation of the moving mechanism.

(4) Fixing Operation

As regards the fixing device E, the controller C turns off the motor M1 in a stand-by state, in which the image forming apparatus A waits for input of an image forming job, so that drive (rotation) of the fixing roller 91 is stopped. Further, the controller C causes the eccentric cam 207 to be in the second rotational angle state so that the pressing mechanism is moved to the spaced position in which the belt unit 200 (belt 210) is spaced from the fixing roller 91.

In this embodiment, in this stand-by state, energization to the heaters 911, 921, 203 and 204 is turned on, so that each of the fixing roller 91, the pressing roller 92 and the belt 210 is temperature-controlled to a predetermined target temperature. The target temperature (control temperature) in this stand-by state may be a predetermined temperature during the image forming operation, or may be a temperature for the stand-by state, which is set to be lower than the predetermined temperature by a predetermined level. Incidentally, in the stand-by state, the energization to the heaters 911, 921, 203 and 204 may also be controlled so as to be turned off.

The controller C shifts a state of the image forming apparatus A from the stand-by state to a state of a warm-up operation (apparatus actuating operation: pre-rotation operation) on the basis of the input of the image forming job (image formation instruction). As regards the fixing device E, the motor M1 is turned on, so that the fixing roller 91 is rotationally driven at a first speed. Correspondingly, the pressing roller 92 is rotated by the rotational drive of the fixing roller 91.

Further, the controller C controls the motor M2, so that the eccentric cam 207 is placed in the first rotational angle state and thus, the belt unit 200 (belt 201) is shifted to the press-contact position in which the belt unit 200 (belt 201) is press-contacted to the fixing roller 91. In this press-contact state, the belt 210 is rotated in the counterclockwise direction of an arrow of FIG. 3 by rotation of the fixing roller 91 through a contact-frictional force in the heating nip Ne between itself and the fixing roller 91. The rollers 201 and 202 are rotated by rotation of the belt 210.

Further, in the case in which the target temperatures (control temperatures) of the fixing roller 91, the pressing roller 92, and the belt 210 in the stand-by state are predetermined temperatures thereof for the stand-by state, which are less than predetermined temperatures during the image forming operation by predetermined levels, setting of these temperatures are switched to setting of predetermined target toners (control temperatures) during the image forming operation.

The controller C causes the image forming portion A2 to perform the image forming operation when a predetermined warm-up operation is ended. As a result, the sheet P carrying thereon the unfixed toner image t is fed from the image forming portion A2 side to the fixing device E and then is guided by a guiding plate 96 into the fixing nip N. The sheet P is nipped and fed through the fixing nip N while a surface thereof, on which the unfixed toner image t is carried, faces the fixing roller 91.

Then, in a process in which the sheet P is nipped and fed through the fixing nip N, the unfixed toner image t is heated by heat of the fixing roller 91 and receives nip pressure, so that the unfixed toner image t is fixed as a fixed image on the sheet surface under application of heat and pressure. The sheet P coming out of the fixing nip N is separated from the surface of the fixing roller 91, and then is discharged and fed from the fixing device E by a discharging units 97 provided in the fixing device E.

A target temperature of the belt 210 of the belt unit 200 is set so as to be greater than a target temperature of the fixing roller 91 by a predetermined level. For that reason, in good response to a lowering in surface temperature of the fixing roller 91 due to contact with the sheet P in the fixing nip N, heat is supplied from the belt 210 to the fixing roller 91, which improves heat sensing accuracy. That is, also during continuous sheet passing, the surface temperature of the fixing roller 91 is satisfactorily maintained.

When a predetermined image forming job is ended, the controller C causes the image forming portion A2 to end the image forming operation, so that the operation of the image forming apparatus A is shifted to a predetermined apparatus ending operation (post-rotation operation). Then, after execution of the apparatus ending operation, the state of the image forming apparatus A is shifted to the stand-by state until a subsequent image forming job is input.

As regards the fixing device E, the motor M1 is turned off, so that the drive of the fixing roller 91 is stopped. Further, the controller C controls the motor M2, so that the eccentric cam 207 is placed in the second rotational angle state and thus, the belt unit 200 (belt 210) is shifted to the spaced position in which the belt unit 200 (belt 210) is spaced from the fixing roller 91. Energization to the heaters 911, 921, 203 and 204 is turned on, so that the temperatures of the fixing roller 91, the pressing roller 92 and the belt 210 are controlled to the respective predetermined target temperatures (predetermined temperatures during the image forming operation or predetermined temperatures during the stand-by state).

Incidentally, the pressing mechanism for pressing the pressing roller 92 toward the fixing roller 91 can also be provided with a moving mechanism for moving the pressing mechanism so as to take a first position in which the fixing nip N is formed by both the rollers and a second position in which both the rollers are spaced from each other. The second position may also be a position in which a force (pressure) exerted between both the rollers is reduced. Further, the controller C can also have a constitution in which the image forming apparatus A controls the moving mechanism so that the pressing mechanism takes the first position during image formation, and takes the second position during non-image formation, such as during the stand-by state.

(5) Reciprocation Control

Figure 4:
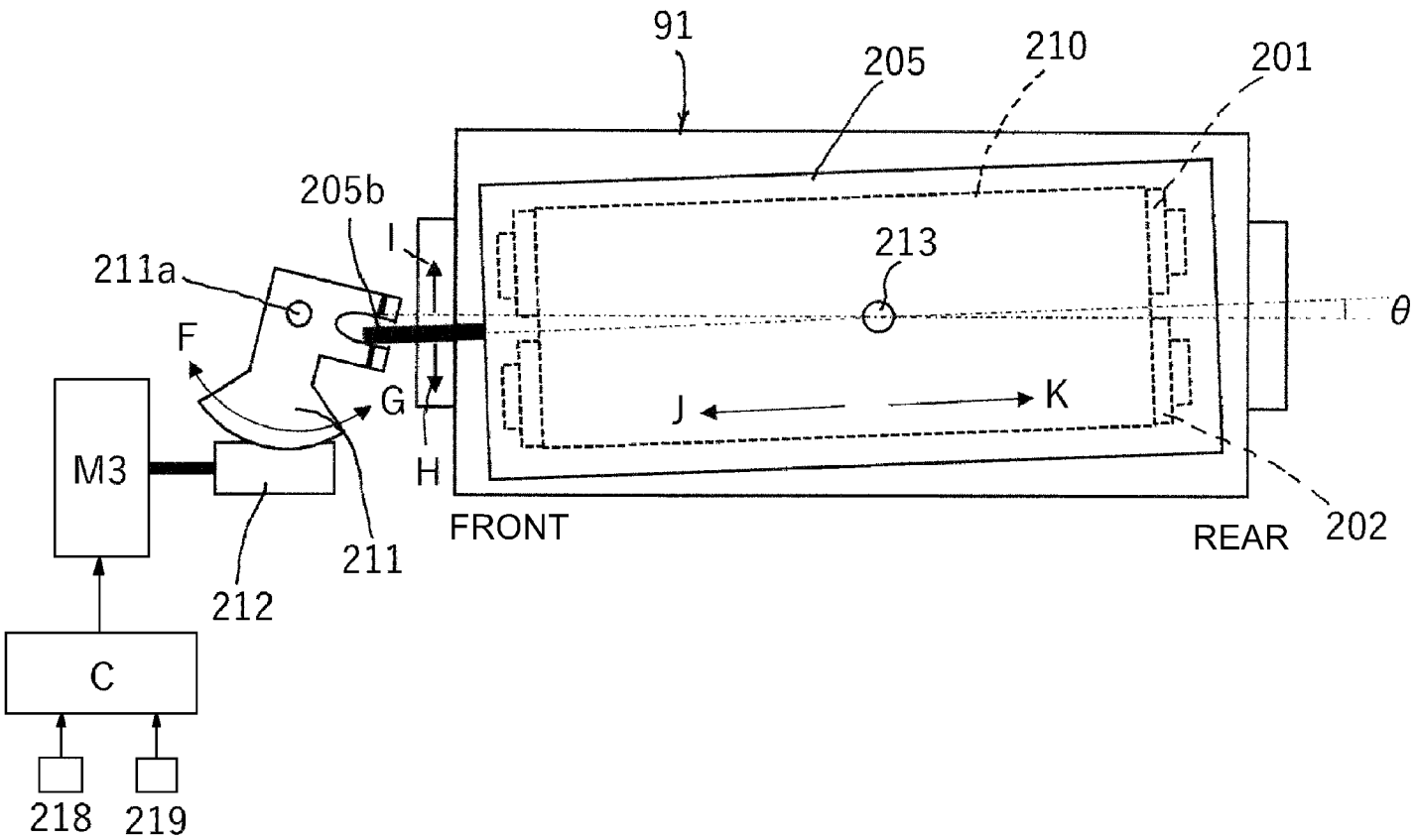
FIG. 4 is an illustration of a steering mechanism for an external heating belt.

FIG. 4 is an illustration of a steering mechanism (switching mechanism) for the belt 210 in the belt unit 200. This steering mechanism adjusts a belt shift so that when the belt 210 is out of a predetermined central zone with respect to the widthwise direction during a rotational state of the belt 201 (in a belt rotation process), the belt 210 is returned to a position within the same. The steering mechanism is controlled by the controller C.

In this embodiment, the rollers 201 and 202 stretching the belt 201 are integrally inclined together with the frame 205 about the rotation shaft 213, so that a crossing angle θ is intentionally set between the belt 210 and the fixing roller 91. As a result, a movement direction of the belt 210 with respect to the widthwise direction (front-rear direction) is controlled. The rotation shaft 213 is a rotation center, about which the crossing angle θ between the belt 210 and the fixing roller 91 is changed.

A sector worm wheel 211, rotatable about a rotation shaft 211*a*, engages with a worm gear 212. When the worm wheel 211 is rotated in an arrow F direction by rotating a motor M3 controlled by the controller C in a normal direction, a supporting shaft 205*b* fixed to one longitudinal end portion of the frame 205 is moved in an arrow H direction. Then, a shifting force in an arrow J direction acts on the belt 210 while following the rotation of the fixing roller 91, so that the belt 210 is moved in the arrow J direction.

On the other hand, when the worm wheel 211 is rotated in an arrow G direction by rotating the motor M3 in a reverse direction, the supporting shaft 205*b* is moved in an arrow J direction, so that a shifting force in an arrow K direction acts on the belt 210 and thus, the belt 210 is moved in the arrow K direction.

By this repeating operation, during the rotational state of the belt 210, the belt 210 can be subjected to a reciprocating operation in a predetermined range (zone) with respect to the widthwise direction of the belt 210. That is, the belt 210 is shift (movement)-controlled.

(6) Belt Shift (Amount) Detecting Sensor

Figure 5:
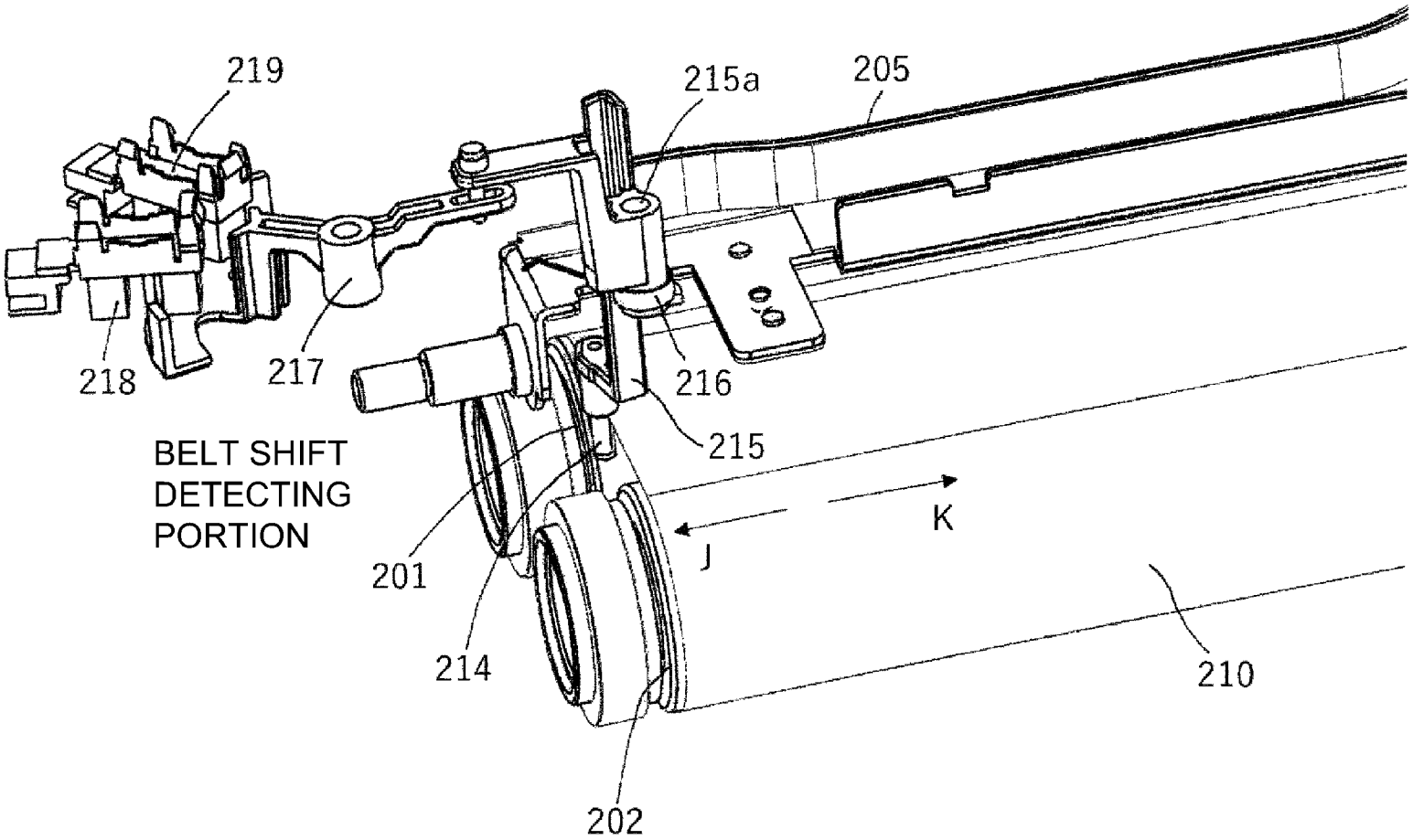
FIG. 5 is an illustration of an arrangement of a belt shift detection sensor.

FIG. 5 is an illustration of an arrangement of a belt shift detecting sensor functioning as a detecting portion. A roller 214, functioning as a contact portion, is provided on the frame 205 side, and is constituted so that the roller 214 can move together with the belt 210 in the widthwise direction of the belt 210 in contact with one end (edge) of the belt 210 with respect to the widthwise direction. The roller 214 is rotatably mounted in an arm 215.

The arm 215 is rotatable about a rotation shaft 215*a* and is urged in the arrow K direction with a force of about 2N (200 gf) by an urging portion 216 incorporating a torsion spring therein. The arm 215 is linked with a sensor flag 217. The sensor flag 217 is rotated in interrelation with motion of the roller 214, i.e., motion of the arm 215. The sensor flag 217 is detected by photo-interrupters 218 and 219.

Referring to FIGS. 4 and 5, when the belt 210 is in a position out of the predetermined central zone with respect to the widthwise direction by being shifted (moved) in the arrow K direction, the sensor flag 217 is detected by the photo-interrupter 219, and detection information is input to the controller C. The controller C rotates the motor M3 of the steering mechanism in the normal direction on the basis of a detection signal. As a result, a shifting force in the arrow J direction acts on the belt 210, so that the belt 210 is moved in the arrow J direction. That is, the belt 210 is movement-controlled in the arrow J direction so as to be returned to the predetermined zone.

Further, when the belt 210 is in a position out of the predetermined central zone with respect to the widthwise direction by being shifted (moved) in the arrow J direction, the sensor flag 217 is detected by the photo-interrupter 218, and detection information is input to the controller C. The controller C rotates the motor M3 of the steering mechanism in the reverse direction on the basis of a detection signal. As a result, a shifting force in the arrow K direction acts on the belt 210, so that the belt 210 is moved in the arrow K direction. That is, the belt 210 is movement-controlled in the arrow K direction so as to be returned to the predetermined zone.

By this repeating operation (switch control), during the rotation state of the belt 210, the belt 210 can be subjected to a reciprocating operation in the predetermined range (zone).

(7) Exchange of Belt

The surface layer of the belt 210 is abraded every use of the belt 210 by being rotated by the fixing roller 91. When a surface roughness due to abrasion reaches a certain level or more, the surface layer of the fixing roller 91 is damaged, so that there is a possibility that the damaged surface layer of the belt 210 causes an image defect. For that reason, when an integrated number of the recording materials (sheets) subjected to the image formation is a certain number (100,000 sheets in terms of an integrated number of passed sheets of A4-size recording materials in this embodiment) or more, exchange of the belt 210 with a new (fresh) belt is recommended. Here, in the following description, the exchange of the belt 210 also includes exchange of an entirety of the belt unit 200 including the belt 210.

Exchange (replacement) of the old belt with the new belt is carried out in a predetermined procedure and a predetermined manner such that an openable door (not shown) of the image forming apparatus A is opened and thus, an inside of the apparatus main assembly A1 is opened, so that the fixing device E is pulled out from a predetermined mounting portion of the apparatus main assembly A1 to an outside, and is exposed to an outside or is dismounted from the apparatus main assembly A1. When the openable door is opened, a kill switch (not shown) is turned off, so that a voltage source circuit (not shown) of the image forming apparatus is open. As a result, electrical protection of an operator is ensured.

When the belt exchange is ended, the fixing device E is mounted in the predetermined mounted portion of the apparatus main assembly A1, and then, the openable door is closed. By this closing of the openable door, the kill switch is turned on, so that the voltage source circuit of the image forming apparatus A is closed. On the basis of this closing of the voltage source circuit, the controller C actuates a main motor (not shown) of the image forming apparatus A and then executes a warm-up operation. When the warm-up operation is ended, the image forming apparatus A is shifted to the stand-by state until an image forming job is input.

As regards the fixing device E, the controller C turns the motor M1 on in the warm-up operation, so that the fixing roller 91 is rotationally driven. With this rotational drive of the fixing roller 91, the pressing roller 92 is rotated. Further, the eccentric cam 207 is placed in the second rotational angle state, and the belt unit 200 (belt 210) is moved to the spaced position in which the belt unit 200 is spaced from the fixing roller 91. Energization to the heaters 911, 921, 203, and 204 is turned on, so that the temperatures of the fixing roller 91, the pressing roller 92, and the belt 210 are increased up to predetermined target temperatures, respectively. In this state, the image forming apparatus A is shifted to the stand-by state.

(8) Aging Operation after Installation of Belt

Parts (a) and (b) of FIG. 6 are schematic sectional views of the belt 210 and the rollers 201 and 202 stretching the belt 210 in a plane passing through a rotation center of the roller 201 (or 202). The layer of the base material, made of the resin material, of the belt 210 is molded with a mold, and, therefore, a surface property of inner and outer peripheral surfaces of the belt 210 varies by the influence of a molding condition, a surface property of the mold, and the like. In a case in which the inner peripheral surface of the belt 210 contacting the rollers 201 and 202 is relatively uneven, as shown in part (a) of FIG. 6, a contact area of the belt 210 with the rollers 201 and 202 is small, and, therefore, friction coefficient is small. As a result, a shifting speed of the belt 210 becomes high, so that an overshoot amount also becomes large.

In a case in which the surface property of the belt 210 is relatively uneven in an initial stage, but the projected surface is abraded and is smoothed, as shown in part (b) of FIG. 6, or in a case in which the belt 210 has a relative flat surface property from the initial stage, the contact area of the belt 210 with the rollers 201 and 202 is large. For that reason, the friction coefficient is large. As a result, the shifting speed of the belt 210 becomes low, so that the overshoot amount also becomes small.

In a case in which the belt 210 is exchanged with a new belt 210, when the new belt 201 is such that roughness of the inner peripheral surface exceeds an Ra of about 0.5, the contact area of the belt 210 with the rollers 201 and 202 decreases, so that a frictional force decreases, and thus, a reciprocating speed of the belt 210 increases. As a result, the overshoot amount increases, and thus, there is a possibility that the belt 210 is placed in a complete shift error.

In the image forming apparatus A of this embodiment, when the operator, such as a user or a service person exchanges (replaces) the belt 210 with a new one, a counter value of a counter (not shown, a belt durability counter) of an integrated number of passed sheets through the belt 210 in the controller C can be reset to 0 (zero). The controller C carries out a subsequent aging operation (running-in) of the fixing device E on the basis of information (indicating that the belt 210 was exchanged) based on the reset of the counter. That is, the controller executes an operation in which the fixing roller 91 is rotated for a predetermined time at a predetermined low speed (less than a rotational speed during the image formation in a state that the belt unit 200 is press-contacted to the fixing roller 91).

That is, the controller C is capable of executing an operation in a first control mode (control mode in an image forming operation) in which the belt unit 200 is moved to the press-contact position with the fixing roller 91, and then, the belt 210 is rotated at a first speed. Further, the controller C is capable of executing an operation in a second control mode (control mode in the aging operation) in which the belt unit 200 is similarly moved to the press-contact position with the fixing roller 91, and then, the belt 210 is rotated for a predetermined time at a predetermined second speed that is less than the first speed. The controller C executes the operation in the second control mode, on the basis of predetermined input information on the belt exchange, during the warm-up operation or during the stand-by state immediately after the input of the information.

Thus, in a state in which the belt 210 is press-contacted to the fixing roller 91 on the basis of the information indicating that the belt 210 was exchanged (with a new one), the controller C additionally performs an operation in which the new belt is rotated for a certain time at a low speed, compared with the rotational speed during the image formation (printing). For that reason, even when a belt having a rough surface property due to a variation in image forming condition is installed, the surface property is smoothened while suppressing overshoot and while performing a reciprocation control operation. As a result, even in a subsequent image forming operation (printing operation), it becomes possible to perform the operation in which the overshoot amount is suppressed, so that generation of a downtime due to complete shift of the belt 210 can be suppressed.

That is, even when the belt 210 is a new belt, by executing the aging operation, the surface roughness is reduced by sliding of the inner peripheral surface of the belt with the rollers 201 and 202. As a result, in a subsequent image forming operation, the overshoot amount lowers, and, therefore, a complete shift error can be suppressed.

FIG. 7 is a screen that is displayed at a display portion (liquid crystal touch panel) of the operating portion D by performing a predetermined operation at the operating portion D, and on which integrated numbers of passed sheets (durability statuses) of various component parts in the image forming apparatus A until then. At a display portion 41, an integrated number of passed sheets counted at a counter portion (not shown) of the controller C from last exchange of the belt 210 until now is displayed. The operator, such as the user or the service person, presses a reset button 42, and then, presses an OK button 43 when the operator exchanges the belt 210 with a new one. As a result, the integrated number of passed sheets of the belt 210 is reset to 0.

Figure 1:
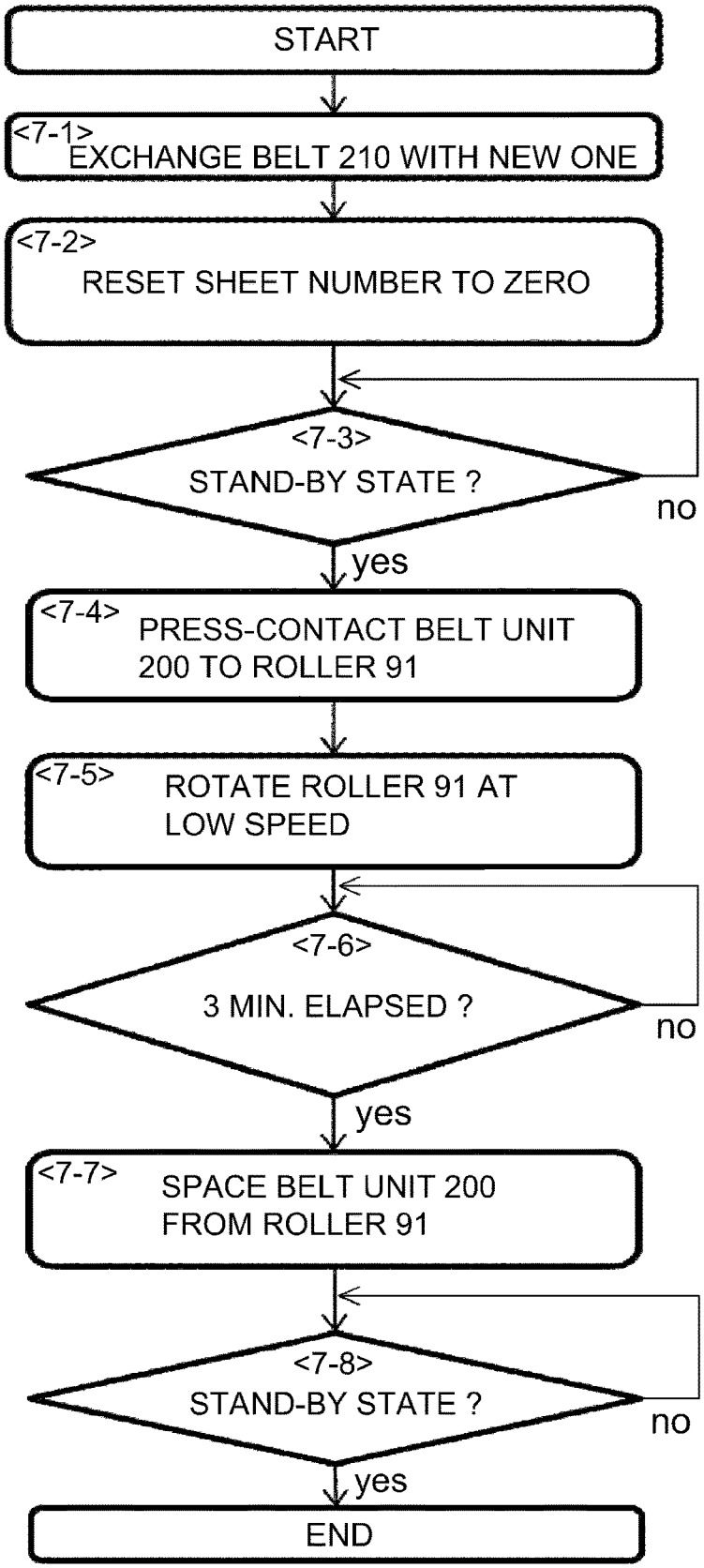
FIG. 1 is a flowchart for illustrating an aging operation in Embodiment 1.

FIG. 1 is a flowchart showing a process in which the aging operation is performed in this embodiment. In this embodiment, when the belt 210 is exchanged with the new one (<7-1>), the aging operation is carried out on the basis of information indicating that the integrated number of passed sheets through the belt 210 is reset to 0 by operating the operating portion D (<7-2>). This aging operation may preferably be completed after the belt 210 is exchanged with the new one and before a fixing process is started in an image forming job after the exchange of the belt 210.

Here, most operators, such as users and service persons, reset the integrated number of passed sheets before a start of the image forming job when the belt 210 is exchanged with the new one, in order to manage a lifetime of the belt 210. In view of this, in this embodiment, a constitution in which the aging operation is carried out on the basis of information of a reset of the integrated number of passed sheets through the belt is employed.

That is, the fixing device E, after the exchange of the belt is ended, is mounted in the predetermined mounting portion of the apparatus main assembly A1, and then, the openable door is closed, so that the voltage source circuit of the image forming apparatus A is closed. On the basis of this, a warm-up operation (initializing operation) is executed, and, thereafter, the image forming apparatus A shifts to the stand-by state, inclusive of the fixing device E. The operating portion D is also in a usable state. The operator resets the integrated number of passed sheets through the belt 210 to 0, as described above, by operating the operating portion D. This reset signal is input as a signal relating to the belt exchange to the controller C (<7-27>).

The controller C checks that the image forming apparatus A is in the stand-by state and temperature control of the fixing device E is completed in order to stabilize an effect of the aging operation (<7-3>), and then, the controller C drives the motor M2, so that the pressing cam 207 is shifted from the second rotational angle state to the first rotational angle state. As a result, the belt unit 200 is shifted to a state in which the belt unit 200 is press-contacted to the fixing roller 91 (<7-4>).

Then, the controller C drives the motor M1, so that the fixing roller 91 is rotated for a predetermined time at a predetermined low speed (second speed) (aging operation) (<7-5>, <7-6>). In this embodiment, the fixing roller 91 is rotated for 3 minutes at a peripheral speed of 100 mm/sec (500 mm/sec during the image forming operation).

At this time, the belt unit 200 is in a state in which the belt unit 200 press-contacts the fixing roller 91, and, therefore, the belt unit 200 is not only rotated by the fixing roller 91, but is also subjected to reciprocating control (switch control) by the steering mechanism. That is, the belt 210 is subjected to the reciprocating operation in an axial direction of the fixing roller 91. At this time, the peripheral speed of the fixing roller 91 is 100 mm/sec (second speed) less than 500 mm/sec (first speed) during normal image formation. For that reason, even if a belt having an inner peripheral surface that has a large surface roughness is installed, the reciprocating operation is performed while suppressing the overshoot amount.

When the reciprocating operation for the predetermined time is completed (<7-6>), the controller C drives the motor M2, and thus, the pressing cam 207 is rotated in the reverse direction, so that the pressing cam 207 is shifted from the first rotational angle state to the second rotational angle state. As a result, the belt unit 200 is spaced from the fixing roller 91 (<7-7>). Further, the motor M1 is turned off, so that rotation of the fixing roller 91 is stopped. Thereafter, a discrimination as to whether or not the fixing device E is in the stand-by state is made (<7-8>), and then, the operation is ended.

Parts (a) and (b) of FIG. 8 are graphs each showing an example of a change in surface roughness (Ra) of the inner peripheral surface of the belt 210 contacting the rollers 201 and 202 before and after the above-described aging operation. The surface roughness is measured at a plurality of points on the inner peripheral surface of the belt 210, and an average of measured values is represented in the graph.

Part (a) of FIG. 8 shows the change in surface roughness before and after the aging operation in a case in which the inner peripheral surface roughness Ra of the belt 210 in the initial stage is about 0.5. The initial surface roughness Ra of about 0.5 is lowered to about 0.13 as the surface roughness Ra after the aging operation, so that it is understood that a degree of the surface unevenness is decreased.

Part (b) of FIG. 8 shows the change in surface roughness before and after the aging operation in a case in which the inner peripheral surface roughness Ra of the belt 210 in the initial stage is about 0.11. It is understood that, as regards the belt having the low surface roughness from the initial stage, a value of Ra is substantially unchanged even when the aging operation is performed. That is, the aging operation has no influence on the belt having the initial surface roughness that is not so large and can achieve an effect on only a belt that has the large initial surface roughness and that has a high possibility of generation of the complete shift error in the reciprocation control of the belt.

FIG. 9 shows an initial belt reciprocating operation and a belt reciprocating operation after the aging operation with respect to the belt 210 having the initial inner peripheral surface roughness Ra of about 0.5, which is high as described in part (a) of FIG. 8. The initial belt reciprocating operation of the belt 210 is represented by a broken line, and it is understood that a movement speed is fast. As a result, the overshoot amount from a shift detection position on each of the front and rear sides is large, and, in some cases, the shift detection position reaches a completely shifted position. Incidentally, originally, the operation of the fixing device E stops at a time when the shift detection position reaches the completely shifted position, but, in this embodiment, a function of stopping the operation of the fixing device E is stopped and the operation of the belt 210 is observed.

The reciprocating operation of the belt 210 after the aging operation is carried out is represented by a solid line. Compared with the initial belt reciprocating operation, a speed of the reciprocating operation is lowered, and the overshoot amount is also decreased, so that it is understood that a sufficient margin is ensured for the completely shifted position. Thus, the aging operation is carried out after the belt 210 is exchanged with the new one, so that a frequency of the complete shift error of the belt 210 immediately after the belt is installed can be reduced.

In this embodiment, as the steering mechanism (FIG. 5) for steering the belt 210, the crossing angle θ of the belt unit 200 relative to the fixing roller 91 is changed by the worm wheel 211 and the motor M3. An example in which a shifting force for shifting the belt 210 is generated by the changed crossing angle θ and thus, the reciprocation control is carried out was described. The steering mechanism is not, however, limited thereto. For example, a similar effect is obtained even by a steering constitution in which the shifting force for shifting the belt 210 is generated by performing an operation such that a center axis of the roller 201 or the roller 202 is inclined relative to the axial direction of the fixing roller 91, and then, the reciprocation control is carried out.

The aging operation for sliding the inner peripheral surface of the belt 210 with the rollers 201 and 202 is carried out in the state in which the belt 210 is contacted to the fixing roller 91. As a result, the inner peripheral surface of the belt 210 can be efficiently slid with the roller 201 or the roller 202 in the nip belt the roller 201 and the belt 210 pressed against the fixing roller 91 or in the nip belt the roller 202 and the belt 210 pressed against the fixing roller 91, respectively.

Incidentally, in the aging operation, it is preferable that not only the belt 210 is placed in the contact state with the fixing roller 91, but also the belt unit 200 is pressed toward the fixing roller 91. That is, during the aging operation, the belt 210 is sandwiched by the fixing roller 91 and the roller 201 with a predetermined pressure or the belt 210 is sandwiched by the fixing roller 91 and the roller 202 with a predetermined pressure. As a result, the inner peripheral surface of the belt 210 can be efficiently slid on the roller 201 or 202.

Further, as described in this embodiment, switch control of the belt 210 by the steering mechanism may preferably be carried out during the aging operation. As a result, the inner peripheral surface of the belt 210 is further efficiently slid in the nip between the fixing roller 91 and the roller 201 or in the nip between the fixing roller 91 and the roller 202.

Further, in this embodiment, a constitution in which in the aging operation, the rollers 201 and 202 are rotated by the fixing roller 91 in a state in which the belt 210 contacts the fixing roller 91 was described, but the following constitution may also be employed.

For example, the rollers 201 and 202 are driven by a driving system provided separately from the fixing roller 91 for the purpose of rotationally driving the belt 210 and thus, the belt 210 is rotationally driven. Also, in a case in which the aging operation is carried out in this constitution, a peripheral speed difference generates between the belt 210 and the roller (201 or 202) on a side on which the driving system is not provided, and, therefore, the inner peripheral surface of the belt 210 can slide.

Also in this constitution, it is preferable that the aging operation is carried out in a state in which the belt 210 is pressed against the fixing roller 91 with a predetermined pressure. It is further preferable that the switch control of the belt 210 by the steering mechanism is carried out during the aging operation.

Further, in this embodiment, the aging operation is carried out under a condition in which the fixing device E is in the stand-by state. In the stand-by state in this embodiment, the belt unit 200 is spaced from the fixing roller 91, so that the belt 210 is not rotated. Therefore, during the stand-by state, there is no liability of an occurrence of the complete shift error of the new belt 210. In the stand-by state in this embodiment, the belt 210 is heated, and, therefore, the inner peripheral surface of the belt 210 is somewhat softened. Accordingly, a sliding effect of the belt 210 is enhanced by performing the aging operation from the stand-by state.

Further, in this embodiment, a constitution in which the belt 210 is not rotated in the stand-by state is employed, but the following constitution may also be employed. That is, a constitution in which the belt 210 is rotated in the stand-by state at a speed (for example, at the same speed as the rotational speed during the aging operation) less than the rotational speed during execution of the fixing process in a predetermined job may also be employed. When the belt 210 is rotated at the same speed as the rotational speed during the aging operation, it is possible to suppress the complete shift error of the belt 210 in the stand-by state before the aging operation.

Incidentally, in this embodiment, the aging operation is carried out under a condition in which the fixing device E is in the stand-by state, but the invention is not limited thereto. The aging operation may also be carried out in another operation state, such as during a warm-up state. In this case, in order to suppress an occurrence of the complete shift error of the new belt 210 during the warm-up state, a constitution in which, in the warm-up state, the belt 210 is rotated at a speed less than the rotational speed during execution of the fixing process in the predetermined job is employed. For example, a constitution in which the belt 210 is rotated at the same speed as the rotational speed during the aging operation is employed.

Embodiment 2

In this embodiment, as shown in FIG. 10, an aging mode execution button can be displayed at the display portion of the operating portion D. At the operating portion D, when the operator presses the aging mode execution button 44 displayed by performing a predetermined operation, and then presses an OK button 45, the aging operation can also be carried out in an arbitrary state. In this embodiment, the aging mode execution button 44 and the OK button 45 constitute an operating portion selectable by the operator as to whether or not an operation in an aging mode (second control mode) should be executed. That is, these buttons are pressed, whereby information indicating that the belt was exchanged is received.

FIG. 11 shows a flowchart in a case in which the aging operation when the aging mode execution button 44 is pressed in this embodiment is carried out.

When the aging mode execution button 44 is pressed and then the OK button 45 is pressed at the operating portion D (<10-1>), the controller C confirms that the image forming apparatus A is in the stand-by state (<10-2>). In that condition, the belt unit 200 is shifted to a state that the belt unit 200 is press-contacted to the fixing roller 91 (<10-3>), and then the motor M1 is driven and the fixing roller 91 is rotated for 3 minutes at a low speed (aging operation) (<10-4>), (<10-5>).

When a reciprocating operation for a predetermined time is completed, the controller C drives the motor M2 and thus, the pressing cam 207 is rotated in the opposite direction, so that the belt unit 200 is spaced from the fixing roller 91 (<10-6>). Then, the controller C discriminates whether or not the fixing device E is in the stand-by state (<10-7>), and the operation is ended. When the operation is completed with no problem, at the display portion of the operating portion D, on a status window 46 (FIG. 10), "OK!" is displayed as indicated by a reference numeral 46 (<10-8>).

In a case in which the aging operation is intended to be additionally carried out after the aging operation automatically performed after initial installation of the belt 210, the aging operation can be carried out by performing the above-described operation.

Embodiment 3

Embodiment 3 will be described using FIGS. 12 and 13. Incidentally, a principal constitution of an image forming apparatus in this embodiment is similar to the image forming apparatus A in Embodiment 1, and, therefore, will be omitted from description.

Parts (a) and (b) of FIG. 12 are schematic views showing a belt 210 in this embodiment. In the neighborhood of each of both end portions of the belt 210, a heat-sensitive material 210*a* having a characteristic such that a hue (tint) is changed from a color-developed state to a decolorized state by once subjecting the heat-sensitive material to a heating process at a predetermined temperature or more. As the color of the color-developed state, various colors are usable, but white is desirable. As a result, it becomes possible to differentiate between the new belt and the used belt.

FIG. 13 is a schematic view of a belt unit 200 in this embodiment. The belt unit 200 in this embodiment has substantially the same constitution as the constitution of the belt unit 200 of FIG. 4 in Embodiment 1, but is provided with an old and new belt discriminating mechanism (detecting portion) 220 at a position opposing the heat-sensitive material (discriminating portion) 210*a* of the belt 210 on one side of the belt 210. The old and new belt discriminating portion 220 is constituted by a photo-sensor including a light-emitting portion and a light-receiving portion, and is constituted so that an output signal of a predetermined level or more is returned only for the color-developed state of white of the heat-sensitive material 210*a*.

The belt 210 is exchanged by the operator, such as a user or a service person, with a new one in a state in which a power switch (main switch) for supplying electrical power to the image forming apparatus A is turned off. Then, when the exchange of the belt 210 is completed, the operator turns on the power switch and thus, actuates the image forming apparatus A.

Then, the old and new belt discriminating mechanism 220 detects reflected light from the heat-sensitive material 210*a* of the belt 210 emitting light in response to the turning-on of the power switch. That is, the old and new belt discriminating mechanism 220 checks whether or not the belt 210 is a new belt, in response to the turning-on of the power switch. When the belt 210 is installed in a brand-new state, the old and new belt discriminating mechanism 220 discriminates that the belt 210 is the new belt, and procession information (information on belt exchange) is inputted to the controller C. The controller C is constituted so that the aging operation is automatically executed in the stand-by state of the image forming apparatus after the input of the discrimination information.

The controller C executes the aging operation so that the aging operation is completed after the belt 210 is discriminated as being exchanged with the new belt and before the fixing process is started in a first image forming job after the exchange of the belt 210. It is preferable that the controller C executes the aging operation so as to be completed after the belt 210 is discriminated as being exchanged with the new belt and before an image forming process in a first image forming job after the exchange of the belt 210 is started.

The aging operation is similar to the aging operation described in Embodiment 1.

As a result, the aging operation is executed with reliability without performing the action of resetting the counter of the integrated number of passed sheets through the belt 210 to 0, as in Embodiment 1. That is, a frequency of an occurrence of the complete shift error of the belt 210 immediately after the belt 210 is installed can be stably reduced.

Embodiment 4

In Embodiment 3, an example in which the belt 210 is exchanged alone was described. In this embodiment, an example in which a belt unit 200 including the belt 210 is exchanged will be described.

The belt unit 200 in this embodiment is provided with a discriminating portion for discriminating old and new belts. The discriminating portion for discriminating the old and new belts is a memory, for example. In a new belt unit 200, a new belt 210 is mounted, and the memory provided in the new belt unit 200 stores information corresponding to a new article in advance. In a state in which the belt unit 200 is mounted in a predetermined mounting portion of the image forming apparatus A, the controller C is capable of accessing the memory of the belt unit 200.

The belt unit 200 is exchanged by the operator, such as a user or a service person, with a new one in a state in which a power switch (main switch) for supplying electrical power to the image forming apparatus A is turned off. Then, when the exchange of the belt unit 200 is completed, the operator turns on the power switch and thus, actuates the image forming apparatus A.

Then, the controller C checks whether or not the information corresponding to the new article is stored by making access to the memory of the belt unit 200, in response to the turning-on of the power switch. That is, the controller C checks whether or not the belt unit 200 is a new belt unit, in response to the turning-on of the power switch. When the belt unit 200 is installed in a brand-new state, the controller C discriminates that the belt unit 200 is the new belt unit by making reference to the information of the memory, and processes that the belt unit 200 is the new belt unit. The controller C is constituted so that the aging operation is automatically executed in the stand-by state of the image forming apparatus after the input of the discrimination information.

The controller C executes the aging operation so that the aging operation is completed after the belt unit 200 is discriminated as being exchanged with the new belt unit and before the fixing process is started in a first image forming job after the exchange of the belt unit 200. It is preferable that the controller C executes the aging operation so as to be completed after the belt unit 200 is discriminated as being exchanged with the new belt unit and before an image forming process in a first image forming job after the exchange of the belt 210 is started.

The aging operation is similar to the aging operation described in Embodiment 1.

Then, with execution of the aging operation, the information that has been stored in the memory of the belt unit 200 and that indicates that the belt unit 200 is the new belt unit is rewritten as information indicating that the belt unit 200 is not the new belt unit. As a result, it is possible to prevent unnecessary execution of the aging operation when the power switch is turned on again from the turned-off state. Therefore, it is possible to suppress an increase in waiting time of the user due to the unnecessary (useless) execution of the aging operation.

Incidentally, in this embodiment, as the discriminating portion for discriminating the old and new belts, the memory, in which the information corresponding to the new article is stored in advance, was described as an example, but the discriminating portion for discriminating the old and new belts is not limited thereto. For example, a constitution in which a memory storing therein discriminating information for discriminating the belt unit 200 from another belt unit (for example, the belt unit before the exchange with the new belt unit) capable of being mounted in the image forming apparatus A is provided in the belt unit 200 may also be employed.

The discrimination information is an individual identification (recognition) number, for example. The controller C reads the discrimination information of the memory of the belt unit 200 for every instance of turning-on of the power switch and stores the read discrimination information in a random access memory (RAM) provided in a main assembly of the image forming apparatus A, or in a memory in the controller. Then, the controller C compares the discrimination information read when the power switch is turned on last with the discrimination information read when the power switch is turned on this time. When these pieces of the discrimination information are different from each other, the controller C discriminates that the new belt unit 200 is mounted.

Incidentally, the discrimination is not limited thereto on the basis of the comparison with the discrimination information during the last turning-on of the power switch, but may also be a constitution in which whether or not the belt unit 200 is the new belt unit 200 is discriminated on the basis of a comparison with a mounting hysteresis of the belt unit 200 in the post. Further, the discriminating portion showing the discrimination information of the belt unit 200 is not limited to the memory, but may also be another means, such as a bar code or a dip switch, showing the discrimination information. Other constitution and effects are similar to those of Embodiments 1 and 3 described above.

Incidentally, the fixing device E may also be used as a glossiness increasing device (image modifying device, which, in this case, is also referred to as the fixing device) for increasing a gloss (glossiness) of an image by re-introducing a sheet on which a toner image is once fixed or temporarily fixed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming portion configured to form a toner image on a recording material;

a first rotatable member and a second rotatable member, which are configured to form a nip therebetween in which the toner image, formed on the recording material by said image forming portion, is heated;

a belt unit including an endless belt configured to externally heat said first rotatable member, and a supporting mechanism rotatably supporting said endless belt;

a moving mechanism configured to move said belt unit so as to be movable between a contact position, in which said endless belt contacts said first rotatable member, and a spaced position, in which said endless belt is spaced from said first rotatable member; and a controller configured to execute a process in which one of (i) said belt unit with a new endless belt and (ii) a new belt unit with a new endless belt is moved to the contact position, and then, said new endless belt is rotated at a first rotational speed for a predetermined time by said first rotatable member, wherein the first rotational speed is less than a second rotational speed at which said endless belt rotates during an image formation, the image formation being in a state in which an image is formed on the recording material by heating the toner image formed on the recording material.

2. The image forming apparatus according to claim 1, further comprising a swinging mechanism configured to swing said endless belt in a widthwise direction of said endless belt, wherein said controller operates said swinging mechanism when said controller executes the process.

3. The image forming apparatus according to claim 1, further comprising a receiving portion configured to receive information indicating that said endless belt is exchanged and to produce an output, wherein said controller executes the process on the basis of the output of said receiving portion.

4. The image forming apparatus according to claim 3, wherein said receiving portion includes a display portion configured to produce a display for receiving the information indicating that said endless belt is exchanged.

5. The image forming apparatus according to claim 1, further comprising a detecting portion configured to detect information indicating that said endless belt is exchanged and to produce an output, wherein said controller executes the process on the basis of the output of said detecting portion.

6. The image forming apparatus according to claim 1, wherein said controller executes a preparatory operation for heating said endless belt in a state in which said belt unit is located in the spaced position.

7. The image forming apparatus according to claim 6, wherein said controller moves said belt unit from the contact position to the spaced position immediately before the recording material is introduced into the nip.

8. The image forming apparatus according to claim 6, wherein said controller executes the preparatory operation on the basis of information prompting exchange of one of said endless belt and said belt unit, and executes the process when a temperature of said endless belt reaches a first temperature and a temperature of said first rotatable member reaches a second temperature.

* * * * *